United States Patent [19]

Hadzimihalis et al.

[11] Patent Number: 4,844,004

[45] Date of Patent: Jul. 4, 1989

[54] METHOD AND APPARATUS FOR APPLYING NARROW, CLOSELY SPACED BEADS OF VISCOUS LIQUID TO A SUBSTRATE

[75] Inventors: Theodore M. Hadzimihalis, Marietta; Charles H. Scholl, Duluth, both of Ga.

[73] Assignee: Nordson Corporation, Westlake, Ohio

[21] Appl. No.: 186,378

[22] Filed: Apr. 26, 1988

Related U.S. Application Data

[62] Division of Ser. No. 76,202, Jul. 21, 1987.

[51] Int. Cl.[4] ..... B05C 1/16

[52] U.S. Cl. ..... 118/315; 118/411; 427/286; 427/421

[58] Field of Search ..... 427/286, 421; 118/411, 118/315

[56] References Cited

U.S. PATENT DOCUMENTS

| | | | |
|---|---|---|---|
| 2,916,012 | 12/1959 | Hergenrother | 118/315 |
| 3,106,481 | 10/1963 | Sorg | 117/44 |
| 3,302,611 | 2/1967 | Gore | 118/411 |
| 3,570,725 | 3/1971 | Baker et al. | 427/128 |
| 3,600,750 | 8/1971 | Stroszynski | 18/15 R |
| 3,690,518 | 9/1972 | Baker et al. | 222/504 |
| 3,825,379 | 7/1974 | Lohkamp et al. | 425/72 |
| 3,840,158 | 10/1974 | Baker et al. | 118/306 |
| 3,849,241 | 11/1974 | Buntin et al. | 156/167 |
| 3,890,926 | 6/1975 | Teed | 118/325 |
| 4,062,492 | 12/1977 | Thornton | 239/125 |
| 4,220,114 | 9/1980 | Radowicz | 118/411 |
| 4,233,346 | 11/1980 | Kerkhofs | 427/345 |
| 4,476,165 | 10/1984 | McIntyre | 427/258 |
| 4,550,681 | 11/1985 | Zimmer et al. | 118/410 |
| 4,557,958 | 12/1985 | Barkis et al. | 428/36 |
| 4,565,718 | 1/1986 | Katsuyama et al. | 427/420 |
| 4,675,208 | 6/1987 | Kageyama et al. | 427/128 |
| 4,679,711 | 7/1987 | Trevathan | 222/330 |

*Primary Examiner*—Shrive Beck

*Attorney, Agent, or Firm*—Wood, Herron & Evans

[57] ABSTRACT

Apparatus for applying multiple narrow, closely spaced beads of viscous liquid, such as hot melt adhesive, to a substrate comprises first and second blades between which there is a thin shim having a plurality of parallel, closely spaced slots open to and in fluid communication with a slot cavity in one of the blades such that high pressure, viscous liquid supplied to the slot cavity exits onto the substrate from between the blades through the slots in the shim.

7 Claims, 2 Drawing Sheets

METHOD AND APPARATUS FOR APPLYING NARROW, CLOSELY SPACED BEADS OF VISCOUS LIQUID TO A SUBSTRATE

This is a division of application Ser. No. 076,202, filed Jul. 21, 1987.

This invention relates to method and apparatus for applying beads of viscous liquids, such as hot melt adhesives or hot melt foams, from dispenser nozzles onto substrates or webs moving relative to the nozzles. More particularly, this invention relates to methods and apparatus for applying multiple, closely spaced, fine beads of viscous liquids to substrates or webs moving relative to a dispenser of such material.

In prior art U.S. Pat. No. 3,570,725 there is disclosed one method and apparatus for applying multiple, closely spaced beads of viscous liquid to a common web or substrate moving beneath multiple nozzles for dispensing such material. According to the disclosure of this patent, the beads of adhesive are closely spaced by angling the nozzles of the guns relative to one another such that they point toward a common target area. Thereby, the beads of adhesive may be more closely spaced than the width of the nozzles would otherwise permit.

Still another prior art patent, U.S. Pat. No. 3,840,158 discloses yet another method and apparatus for applying closely spaced beads of viscous liquid to a common substrate or web. According to the disclosure of this patent, multiple, very small cylindrical guns are mounted in a common manifold with the guns being connected in series between common air and liquid supply lines contained in the manifold block. Thereby, the spacing between parallel streams of viscous liquid emitted from the nozzles of the guns is reduced without the need to aim the nozzles of the guns toward a common target area as in the earlier U.S. Pat. No. 3,570,725.

There are now applications for applying viscous liquids to substrates which require smaller beads and even closer spacing between parallel beads applied to a moving substrate or moving web than is possible with these prior art dispensers. In one such application, multiple, parallel, very fine or small beads of molten thermoplastic adhesive are to be deposited on a moving web of paper to produce upstanding beads or ribs of solid thermoplastic material on the paper web. After the molten thermoplastic material has partially cooled, the paper is rolled up to form a tubular article with each layer of the article being adhered to, but slightly spaced from, the adjacent layer by a plurality of these fine beads.

Another application which requires a plurality of closely spaced beads of viscous thermoplastic material is described in co-pending application Ser. No. 841,587 filed Mar. 20, 1986, which application is assigned to the assignee of this application. According to the disclosure of this co-pending application, beads of thermoplastic adhesive are applied to non-woven fabric diapers by a so-called "coat hanger die nozzle." But, coat hanger die nozzles are relatively expensive to produce and may be subject to clogging or plugging if the adhesive becomes contaminated when used to apply small beads of adhesive. They are also time consuming to disassemble and clean in the event that they should ever become clogged or plugged. Additionally, changes of adhesive patterns dispensed from coat hanger dies requires replacement of the entire die.

With the many improvements in viscous liquids and the new uses for such viscous liquids, there has developed a need for new and improved methods and apparatus for applying those materials to meet these many new uses. This invention represents one improvement wherein the viscous liquid material may be applied to a web or moving substrate in very fine, closely spaced beads, much narrower and much more closely spaced, than has heretofore been possible with prior art applicators and nozzle dispensers.

It has therefore been an objective of this invention to provide a new and improved method and apparatus for applying multiple, narrow, closely spaced, parallel beads of viscous liquid upon a moving web or substrate, which beads are much finer or narrower and much more closely spaced than has heretofore been possible.

Still another objective of this invention has been to provide an improved method and apparatus for dispensing very fine or narrow beads of closely spaced viscous material upon a moving web or moving substrate, which method and apparatus utilizes dies which are much less expensive to manufacture and to maintain than prior art apparatus and dies for applying closely spaced beads of viscous liquid to a substrate or web.

Still another objective of this invention has been to provide an improved apparatus for dispensing closely spaced beads of viscous material, which apparatus may be relatively easily and inexpensively converted from dispensing one pattern of beads to another.

In accordance with these objectives, the invention of this application comprises a method and apparatus for pumping fluids synchronously with the movement of a web or substrate into an inlet port on one side of a narrow lateral slot cavity, which slot cavity extends laterally of the longitudinal direction of movement of the web, directing the fluid from the inlet port laterally along the slot cavity laterally of the direction of movement of the web and projecting the laterally directed fluid in the slot cavity transversely outwardly through parallel restrictor orifices into a second laterally extending slot, which second slot has exit openings exposed to the web, but which exit openings are spaced a substantial distance above the web such that the beads of viscous fluid emitted from the exit openings are not sheared as they are emitted from the exit openings. In accordance with the practice of this invention, the parallel spaced slots through which the liquid is emitted are defined within a shim contained between two spaced blades of a so-called "slot nozzle" wherein the shim slots communicate with a longitudinal slot cavity contained within one of the blades.

Prior to this invention, such blade and shim assemblies have been utilized in so-called "slot nozzles" wherein the shim defines one or two slots of substatial width, such as about one inch or more, and wherein one of the blades is a doctor blade utilized to contact and shear the adhesive as it is emitted from the slot nozzle.

In accordance with one aspect of this invention, there are multiple parallel slots in the shim, which slots are very narrow in width and are very closely spaced. In one preferred practice of this invention, utilized to obtain mutliple closely spaced, "standoff beads" i.e., beads which provide a standoff gap between two substrates adhered together by the adhesive properties of the beads, there are 61 parallel spaced slots in the shim, each slot of which is 0.012 inches in width and spaced apart 0.10 inches. Thereby, there are 61 such slots defined over a six-inch span of the shim. In this one preferred embodiment of the invention, the shim is 0.016 inches in thickness.

In another preferred practice of this invention, utilized to obtain complete surface coverage of the interface between two substrates after compression of the beads between the substrates adhered together by the adhesive properties of the thermoplastic material dispensed through the multiple, parallel slots in the shim, the slots were 0.016 inches in width and spaced apart centerline to centerline 0.100 inches. The shim was 0.015 inches in thickness.

Of course, other applications of the invention require changes in the spacing of the slots, as well as variation in the width of the slot and the thickness of the shim.

The primary advantage of the invention of this application is that it enables, via a relatively inexpensive nozzle assembly, a plurality of very fine, substantially uniform beads of thermoplastic material to be applied to a substrate moving beneath the nozzle assembly. This nozzle assembly also has the advantage of being very easily disassembled and cleaned in the event that it should ever become clogged. It also provides a very versatile nozzle in that the width and spacing of the beads of material dispensed from the nozzle may be easily varied by simply changing from one shim to another. It also lends itself to the use of spare subassemblies of dies and shims which may be quickly changed to avoid machine downtime.

Yet another advantage of this invention is that it enables multiple, spaced, high beads of viscous material, such as molten thermoplastic adhesive, to be applied to one substrate with such close spacing that subsequent to application, the beads may be compressed between that one substrate and a second substrate so as to completely cover the surface of the two substrates. The advantage of this application technique is that it enables the complete surface of a substrate to be covered by a viscous liquid without that liquid having to contact and be sheared by a blade of an applicator nozzle such as is required when viscous liquid is applied to a substrate by a "slot nozzle."

These and other objects and advantages of this invention will become more readily apparent from the following description of the drawings in which.

Figure 1:
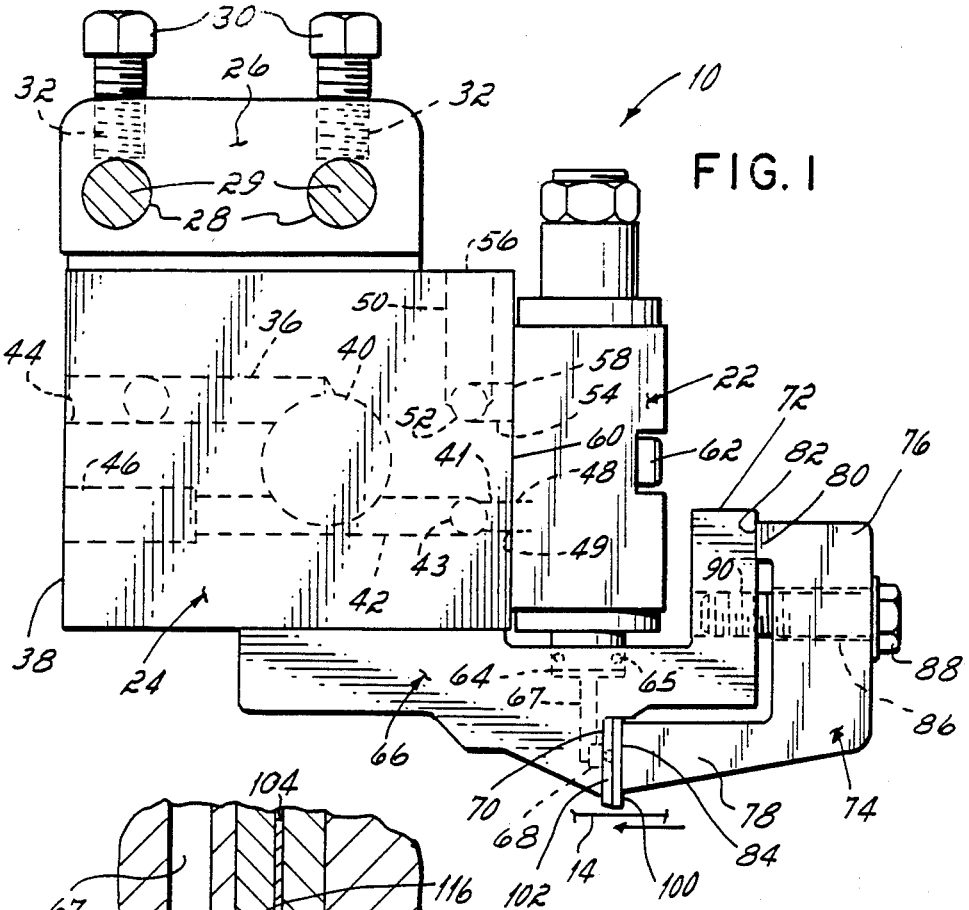
FIG. 1 is a side elevational view of an apparatus for applying multiple, narrow, closely spaced beads of viscous material to a substrate in accordance with the invention of this application.
Figures 2, 2A:
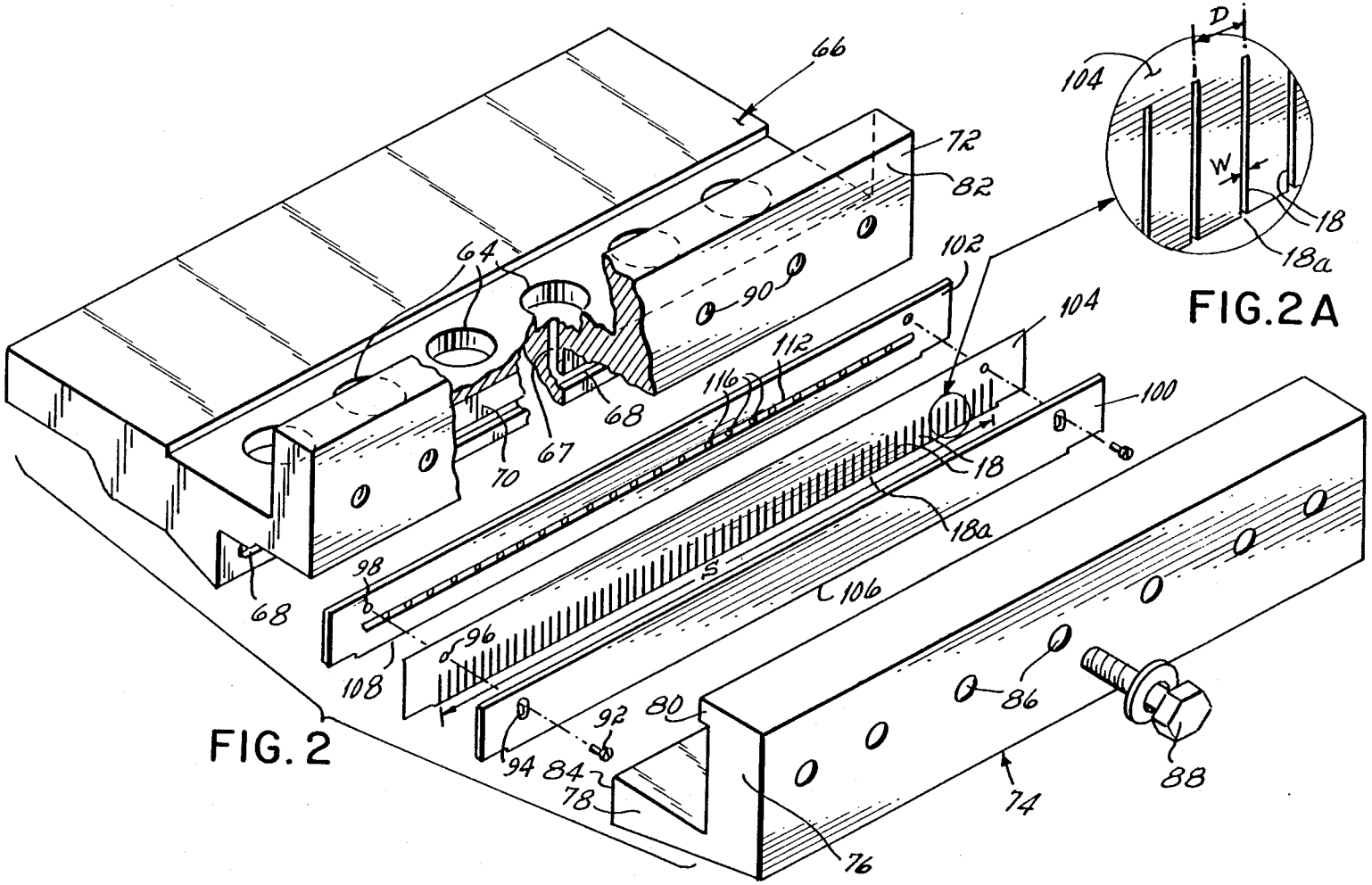
FIG. 2 is an exploded perspective view of a portion of the apparatus of FIG. 1.
FIG. 2A is an enlarged perspective view of a portion of the shim of FIG. 2.

With reference first to FIGS. 1 and 2, it will be seen that the invention of this application is directed to an apparatus 10 for applying multiple, narrow, closely spaced beads 12 of viscous liquid to a substrate or web 14 moving beneath multiple, closely spaced, narrow slots 18 having exit openings 18*a* (FIG. 2A) of a nozzle assembly 16. This apparatus 10 is operable to direct pressurized, spaced streams of the viscous adhesive from the apparatus 10 onto the substrate or web 14. That substrate or web generally moves past the nozzle under tension and at a controlled speed, although it may be positioned on a conveyor which moves the substrate past the nozzle at a controlled speed. The movement of substrate past the nozzle is synchronized with the discharge of viscous liquid from the apparatus 10.

The preferred embodiment of this invention comprises multiple dispensing guns 22 mounted upon a manifold block 24, which manifold block is in turn fixedly attached to a mounting block 26. The mounting block 26 has a pair of transverse bores 28 extending therethrough, which transverse bores 28 are adapted to receive guide rods 29 upon which the mounting block is mounted. The mounting block is secured in a position of adjustment on the guide rods by set screws 30 threaded into bores 32 which intersect the guide rod mounting bores 28.

The manifold block 24 has a first longitudinally extending passageway 36 extending from the rear side 38 thereof into a transverse filter receiving bore 40. The opposite ends of this transverse bore 40 are closed by plugs (not shown). Also intersecting this transverse bore 40 is a longitudinal bore 42 which extends from the rear side 38 to a transverse bore 43. The bore 43 is closed at the ends by conventional plugs (not shown) and is connected via multiple parallel gun feeding bores 41 to outlet ports 49 of the manifold block. These outlet ports are aligned with inlet ports 48 of the dispensing guns so that one outlet port supplies viscous liquid to one dispensing gun 22. The rear of the longitudinal bore 42 ,is closed by a conventional threaded plug 46. The network of bores 36, 40, 41, 42, and 43 through the manifold block 24 described hereinabove provides a flow passageway from a liquid inlet port 44 to multiple outlet ports 49 of bores 41 for viscous liquids supplied from a pressurized source (not shown) of such viscous liquid. From the outlet ports 49 of the manifold block, the viscous liquid passes into liquid inlet ports 48 of the dispensing guns 22.

In addition to the viscous liquid flow passageways contained within the manifold block, there is also an air flow passageway defined by a vertical bore 50, an intersecting transverse bore 52, and multiple horizontal discharge bores 54. The transverse bore 52 extends for the length of the manifold block and is closed at the ends by conventional plugs. As a consequence of these interconnected, intersecting bores 50, 52, 54, pressurized air supplied from a source (not shown) of pressurized air through a flow control valve (not shown) is supplied from an air inlet port 56 of the manifold block 24 to discharge bores 54 of the same block. Each of the discharge bores 54 terminates in an outlet port 58 which opens into and communicates with an air inlet port of one of the dispensing guns 22.

The dispensing guns 22 are conventional pneumatic operated, viscous liquid dispensing guns such as the guns disclosed in U.S. Pat. No. 3,570,725. One such gun suitable for use in the apparatus 10 is manufactured by Nordson Corporation and is designated as the Nordson Corporation H-200 Dispensing Gun.

One or more dispensing guns 22 are secured to the front side 60 of the manifold block 24 by conventional mounting screws 62. In the illustrated embodiment, there are six such guns 22 mounted atop the manifold block 24. The lower end of each of these guns 22 is mounted within a mounting bore 64 of an adaptor block 66. This adaptor block is secured by conventional connectors (not shown) to the underside of the manifold block 24.

There is an O-ring 65 surrounding the gun 22 and engageable with the gun mounting bore 64. This O-ring 65 facilitates assembly of the manifold block 24, guns 22 and adaptor block 66. To assemble these elements, the guns 22 are bolted to the manifold block 24 and the adaptor block 66 is pushed into place with the O-ring seals 65 between the guns and the bores 64 forming a seal between the gun and the liquid flow path through the adaptor block 66.

The adaptor block has a liquid flow passage 67 extending downwardly from each of the mounting bores or recesses 64 in the adaptor block such that liquid discharged from each dispensing gun 22 is caused to flow into one of the liquid flow passages 67. Each of the vertical bores 67 in turn intersects a horizontally extending channel 68. The channel 68 in turn extends from the vertical bores 67 to the front vertical face 70 of the adaptor block 66.

Extending upwardy from the front end of the adaptor block, there is a vertical leg 72 from which is hung a clamping plate 74. This clamping plate 74 is generally L-shaped and has a vertical leg 76, as well as a horizontal leg 78. The vertical leg has a lip 80 which extends rearwardly and engages a front wall 82 of the adaptor block 66. The lower horizontal leg 78 of the clamping plate has a vertical clamping surface 84 which, as explained more fully hereinafter, contacts and functions to clamp the nozzle assembly 16 between the adaptor block 66 and the clamping plate 74.

In order to mount the clamping plate to the adaptor block, there are a plurality of bores 86 extending through the clamping plate. Each of these bores receives a threaded screw 88, the end of which is threaded into a threaded recess 90 in the vertical leg 72 of the adaptor block 66. When the screw 88 is threaded into the threaded recess 90, it tends to cause the clamping plate to pivot about the lip 80 so as to clamp the nozzle assembly 16 between the forward face 70 of the adaptor block 66 and the rear face 84 of the clamping plate.

The nozzle assembly 16 comprises a front blade 100, a rear blade 102, and a thin shim 104 sandwiched between the front blade 100 and rear blade 102. The blades and shim are preferably maintained as a preassembled subassembly by a pair of machine screws 92 which pass through countersunk slots 94 of the front blade and through holes 96 of the shim into threaded bores 98 of the rear blade 102.

Both blades 100, 102 are generally rectangular in configuration and, in one preferred embodiment, are each 1/16 inch in thickness. In this preferred embodiment, the front blade has a bottom surface 106 which is located in a horizontal plane, while the rear blade 102 has a bottom surface 108 which slopes upwardly and rearwardly from the leading edge 110 of the rear blade.

Figure 3:
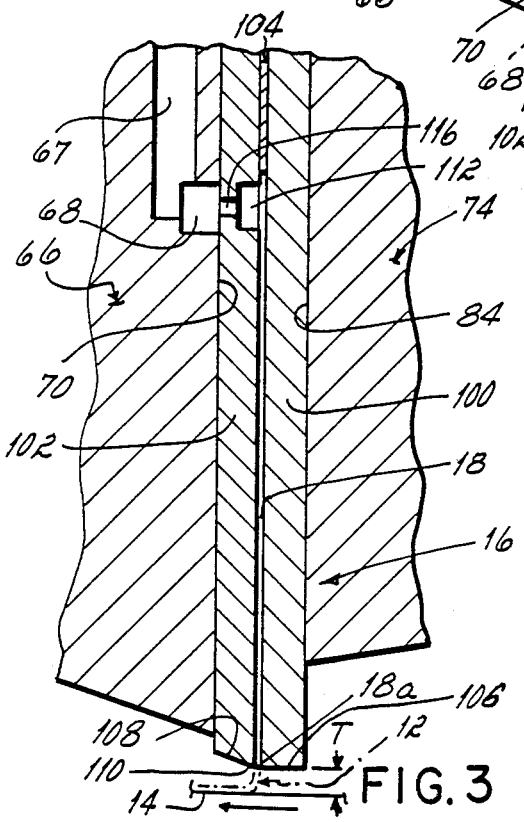
FIG. 3 is an enlarged cross-sectional view through the blade assembly portion of the apparatus of FIG. 1.

With reference to FIG. 3, it will be seen that the rear blade 102 has a longitudinal slot cavity 112 which extends laterally of the direction of movement of the web 14, which direction is indicated by an arrow 114. Extending between the longitudinal slot cavity 112 and the horizontal channel 68 of the adaptor block 66, there are a plurality of small parallel, restrictor passageways 116 through the blade 102. As a consequence of this connection between the longitudinal slot cavity 112 of the rear blade 102 and the longitudinal slot cavity 68 in the adaptor block 66, viscous liquid which flows past the valves (not shown) of the dispensing guns flows through the bores 67, channel 68, through the parallel restrictor passageways 116 in the blade, into the longitudinal slot cavity 112. This longitudinal slot cavity 112 of the rear blade 102 communicates with a plurality of closely spaced, narrow vertical slots 18 in the shim 104. Consequently, viscous liquid supplied to the slot cavity 112 in the rear blade flows out of the slots 18 of the shim onto the moving web or substrate 14.

The nozzle assembly 16 is used in its broadest sense to apply multiple, parallel, closely spaced beads of viscous liquid, as for example, molten thermoplastic adhesive material, to a substrate. The thickness of the shim 104, the width of the slots 18, the length of the slots 18, and the dimension of the restrictor orifices 116, as well as the characteristics of the viscous liquid being applied by the nozzle assembly, dictate and control the dimensions and contour of the beads of viscous material emitted from the nozzle assembly. The plurality of holes 116 in the blade 102 provide a restrictor in the flow path from the transverse channel 68 to the second transverse channel 112 in the blade 102. This baffle or restrictor type distribution of viscous liquid into the second transverse channel 112 provides good uniformity of viscous liquid across the entire width of the die and provides a resistance in the system which aids in providing good, sharp cutoff of liquid flow from the nozzle assembly when the nozzle assembly is operated intermittently to provide interrupted beads over the surface of a substrate. The width and length of the slots 18 also contribute to the surprisingly sharp cutoff of beads when the nozzle is operated intermittently. These dimensions, though, i.e., the width and length of the slots 18, as well as the dimensions of the restrictor orifices 116, vary depending upon the material being used and the temperature of that material at application. Generally speaking, in order to obtain sharp cutoff, the shim must be sufficiently thin, the width of the slot must be sufficiently low, and the length of the slot sufficiently long that the flow resistance is sufficient to cut off the flow of liquid from the exit orifices of the die when the guns 22 are cut off.

In some applications of the nozzle assembly 16 of this invention, the nozzle assembly is used to deposit parallel beads which provide a vertical standoff or separation between two substrates adhered together by the beads. When so used, the characteristics of the viscous molten thermoplastic adhesive, the operating temperature, the shim thickness, the slot width, and the substrate speed, all contribute to successful application of standoff beads to a substrate. For this type of standoff application, these parameters are chosen so as to obtain round, stable beads which substantially maintain their cross-sectional configuration when a second substrate is applied to a first substrate having the beads applied thereto. In that event, the distance between adjacent beads is dictated solely by the desired spacing of the beads in the final product.

In yet other applications of this invention, the viscous liquid material, as well as the shim and restrictor orifices' parameters, are all selected so as to obtain full surface coverage of the interface between two substrates when a second substrate is used to compress the beads of viscous adhesive applied according to the practice of this invention. If full surface coverage is to be obtained, the thickness of the shim and the width of the slot 18 must be sufficiently great relative to the center line spacing of the slots to obtain parallel beads having sufficient viscous material volume therein to enable the beads to merge when squeezed together between the two substrates.

In one preferred embodiment of the invention wherein the invention was used to apply multiple, closely spaced, parallel standoff beads, i.e., beads which, when cooled and solidified, would act as solid spacers between two substrates which are adhered together by the adhesive properties of the beads, the shim 104 is generally rectangular in configuration and is manufactured from brass shim stock 0.016 inches in thickness. In this embodiment of the invention, the slots 18 are each 0.012 inches in width W and are spaced apart, center line to center line, a distance D of 0.10 inches. There are 61 slots extending over a 6 inch span S of the shim stock. This particular embodiment of the invention is utilized to apply 61 very closely spaced thin beads of molten thermoplastic adhesive to a moving substrate 14 as that substrate passes beneath the nozzle assembly 16. The substrate is spaced a sufficient distance T vertically from the exit openings 18*a* of the nozzle assembly 16 that the beads may be applied to the substrate without the beads being sheared by contact with the rearwardmost blade 102. In one use or application of this preferred embodiment of the invention, the material applied by the nozzle assembly was a molten thermoplastic material manufactured by Eastman Kodak Co. and identified as Eastman A32. The material was dispensed at a temperature of 370° F. onto a substrate travelling at 100 feet per minute. This resulted in the application of a plurality of parallel, continuous beads having a substantially round, cross-sectional configuration with small flats at the interfaces of the beads with the spaced, parallel substrates adhered together by the beads.

In another use of a second preferred embodiment of the invention, the nozzle assembly 16 was used to provide full film surface coverage of the surface interface between two substrates adhered together by the material dispensed from the nozzle assembly 16. For this application, the thermoplastic material applied by the nozzle was an adhesive manufactured by National Starch Co. and identified as their No. 342888 adhesive. This material was applied at an application temperature of 350° F. onto a substrate travelling at 185 feet per minute. The shim for this application was 0.015 inches in thickness, the slots were 0.016 inches wide, and the slots were spaced centerline to centerline 0.100 inches apart. This resulted in the application of multiple, parallel beads of adhesive onto the substrate which, when the adhesive was compressed between the substrate and a second substrate, completely covered the interface between the substrates.

Other applications of this invention will employ shims 104 of differing thickness and having slots of differing width and spacing. It is contemplated that the shim stock from which the shims are manufactured may be as little as 0.002 inches in thickness or as great as 0.010 inches in thickness. The slots may be as wide as 0.010 inches in thickness. These dimensions, as well as the spacing between the slots, are, of course, dependent upon the results desired, as for example, standoff or spacing of the substrates adhered by the beads of adhesive or complete surface coverage of the interface between the substrates after compression of the beads between the adhered substrates. Other factors determinative of the spacing and configuration of the beads are the nature of the adhesive or material being applied by the nozzle assembly 16, the application temperature, and the speed of the substrate beneath the nozzle exit openings.

In the use of the apparatus 10 of this invention, viscous liquid, such as molten thermoplastic adhesive, is supplied under pressure from a source of the viscous liquid to the inlet port 44 of the manifold block. The viscous liquid passes through the manifold block to the discharge port 49 or ports, depending upon the number of dispensing guns 22 mounted upon the manifold block, and into the dispensing guns 22. High pressure air is supplied from a source of high pressure air (not shown) to the inlet port 56 of the manifold block. This high pressure air passes through the manifold block into the dispensing guns where it controls actuation of pneumatic cylinders contained internally of the dispensing guns. Whenever such high pressure air is supplied to the guns, it causes the valves (not shown) of the guns to be opened, thereby permitting the flow of high pressure viscous liquid through the guns 22 into the liquid flow passage 67 of the adaptor block, and subsequently into the longitudinal slot cavity 112 of the rear blade 102 of the nozzle assembly 16. This high pressure viscous liquid then flows from the longitudinal slot cavity 112 into the vertical slots 18 of the shim. The viscous liquid then exits from the exit openings or discharge openings 18*a* of the slots 18 onto the substrate or web 14 moving beneath the nozzle assembly 16.

In FIG. 3, the beads of viscous material applied to the web 14 are illustrated as continuous beads. In many instances, though, the beads will be discontinuous or intermittent. In the event that the beads are to be intermittent, then the air supply to the inlet port 56 is controlled via a solenoid or other valve such as to control intermittent opening and closing of the valves (not shown) of the dispensing guns 22. Because the slots 18 of the nozzle assembly 16 are so small and because of the relatively high viscosity of the liquid discharged from these nozzles, the intermittent flow of viscous liquid from the nozzle assembly is characterized by surprisingly sharp, non-contact cut off upon closing of the valves of the guns 22. There is no tendency for the nozzle assembly to drip or drool viscous liquid as is characteristic of many prior art guns for applying intermittent beads to a substrate.

Figure 4:
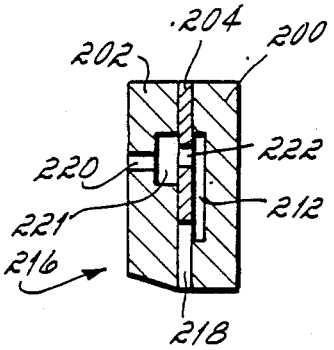
FIG. 4 is a cross-sectional view similar to FIG. 3, but of a modified form of nozzle assembly which may be used in the practice of this invention.

With reference now to FIG. 4, there is illustrated another embodiment of the nozzle assembly 216 of the apparatus 10 of the invention. In this embodiment, a longitudinal slot cavity 212 is located in the rear surface of the front blade 200. In order for viscous liquid to flow from the channel 68 in the adaptor block into the slot cavity 212 of the front blade, there are a plurality of flow passages 220 extending through the rear blade 202 into a longitudinal slot cavity 221 in the rear surface of the rear blade. The longitudinal slot cavity 221 of the rear blade is open to passageways 222 in the shim 204 which communicate with the slot cavity 212 of the front blade. In this embodiment, the slots 218 of the shim 204 are identical to the slots 18 in the first embodiment and are open at the top to the bottom of the slot cavity 212. By providing holes or ports 222 through the shim through which the viscous liquid is supplied into the slot cavity 212 in the front blade, there is a better opportunity for the pressure of the viscous liquid supplied to the different slots 218 of the blade to be equalized.

Figure 5:
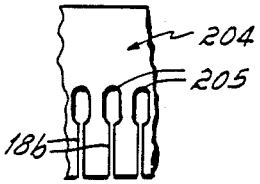
FIG. 5 is a fragmentary front elevational view of a second embodiment of shim utilized in the practice of this invention.

With reference now to FIG. 5, there is illustrated another modification of the shim which has been used to obtain very satisfactory results when employed in the nozzle assembly 16 of this invention. This shim 204 is identical to the shim 104 heretofore described, except that each of the slots 18*b* terminates at its upper end in a generally enlarged, oblong hole 205. When the shim 204 is employed in the nozzle assembly 16, this hole of each slot 18*b* communicates with the transverse channel 112. Thereby, viscous liquid flowing to the channel 112 is enabled to flow through the oblong holes 205 into the slots 18*b*. In all other respects, other than the configuration of the top of the slots 18*b*, the shim 204 is identical to the shim 104 heretofore described.

While we have described only two embodiments of our invention, persons skilled in this art will appreciate changes and modifications which may be made without departing from the spirit of our invention. Therefore, we do not intend to be limited except by the scope of the following appended claims.

We claim:

1. Apparatus for applying multiple, narrow, closely spaced, parallel beads of viscous fluid upon a moving substrate, which apparatus comprises support means for said substrate, a first blade having a bottom side and a narrow longitudinal slot cavity on one other side thereof, said blade having inlet port means opening into said slot cavity, said slot cavity extending laterally of the direction of movement of the substrate, a second blade having a bottom side and a substantially flat surface on one other side thereof, a shim sandwiched between said other side of said first blade and said other side of said second blade, said shim having a plurality of parallel, spaced slots open to one edge of said shim and in fluid communication with said slot cavity of said first blade, said one edge of said shim being exposed to the substrate but spaced therefrom, said parallel, spaced slots of said shim being spaced apart laterally of the direction of movement of said web, said spaced slots of said shim being no more than approximately 0.10 inches in width and said shim being no more than approximately 0.10 inches in thickness such that beads of said viscous material emitted from exit openings are narrow and vary closely spaced, and said bottom sides of said first and second blades and said one edge of said shim being spaced a substantial distance above said support means for said substrate such that the beads of viscous fluid emitted from said spaced slots are not sheared by one of said blades as they are emitted from said exit openings.

2. The apparatus of claim 1 wherein said beads are spaced apart a center-to-center distance of no more than 0.20 inches.

3. The apparatus of claim 1 wherein said inlet port means opening into said slot cavity of said first blade comprises a plurality of small restrictor inlet ports spaced along the length of said slot cavity.

4. Apparatus for applying multiple, narrow, closely spaced, parallel beads of viscous fluid upon a moving substrate, which apparatus comprises support means for said substrate, a first blade having a bottom side and a narrow longitudinal slot cavity on one other side thereof, said blade having inlet port means opening into said slot cavity, said slot cavity extending laterally of the direction of movement of the substrate, a second blade having a bottom side and a substantially flat surface on one other side thereof, a shim sandwiched between said other side of said first blade and said other side of said second blade, said shim having a plurality of parallel, spaced slots open to one edge of said shim and in fluid communication with said slot cavity of said first blade, said one edge of said shim being exposed to the substrate but spaced therefrom, said parallel, spaced slots of said shim being spaced apart laterally of the direction of movement of said web, said spaced slots of said shim being narrow in width and being closely spaced such that beads of said viscous material emitted from exit openings are narrow and vary closely spaced, and said bottom sides of said first and second blades and said one edge of said shim being spaced a substantial distance above said support means for said substrate such that the beads of viscous fluid emitted from said spaced slots are not sheared by one of said blades as they are emitted from said exit openings.

5. The apparatus of claim 4 wherein said inlet port means opening into said slot cavity of said first blade comprises a plurality of small inlet restrictor ports spaced along the length of said slot cavity.

6. The apparatus of claim 4 wherein said viscous fluid is an adhesive and said beads are of such a size and configuration relative to the properties of the viscous fluid adhesive that the beads applied to said substrate from a standoff bead between said substrate and a second substrate placed atop said beads and adhered to said substrate by said beads.

7. The apparatus of claim 4 wherein said beads are of such height and width relative to the spacing of the beads that they completely cover the surface of the substrate when compressed between said substrate and a second substrate.

* * * * *